United States Patent [19]

Romanski et al.

[11] 4,141,388

[45] Feb. 27, 1979

[54] PAPER MACHINE DRYER FABRIC

[75] Inventors: Eric R. Romanski, Delmar; Michael J. Josef, Clifton Park, both of N.Y.

[73] Assignee: Albany International Corporation, Menands, N.Y.

[21] Appl. No.: 780,278

[22] Filed: Mar. 23, 1977

[51] Int. Cl.[2] ..... D03D 25/00; D21F 7/10; D21F 7/12

[52] U.S. Cl. ..... 139/383 A; 162/DIG. 1; 245/10

[58] Field of Search ..... 139/383 A, 383 R, 425 A, 139/408–413; 162/DIG. 1, 348, 349, 358; 245/10; 34/95

[56] References Cited

U.S. PATENT DOCUMENTS

| | | | |
|---|---|---|---|
| 3,214,329 | 10/1965 | Wicker | 139/383 A |
| 3,613,258 | 10/1971 | Jamieson | 139/383 A |
| 4,006,760 | 2/1977 | Romanski et al. | 139/383 A |

FOREIGN PATENT DOCUMENTS

| | | | |
|---|---|---|---|
| 516296 | 2/1955 | Italy | 139/383 A |
| 521690 | 3/1955 | Italy | 139/383 A |
| 1207446 | 9/1970 | United Kingdom | 139/383 A |
| 1220531 | 1/1971 | United Kingdom | 139/383 A |

*Primary Examiner*—James Kee Chi

[57] ABSTRACT

The disclosure is of a multi-layer, flat woven, composite fabric having a duplex weave base of synthetic, polymeric resin monofilaments and a soft surface of multifilament or spun yarns. The fabric is useful as a conventional dryer felt and may also be used as a hot air impingement dryer felt. The fabric is especially advantageous for dryer felts employed for the manufacture of fragile papers.

12 Claims, 4 Drawing Figures

PAPER MACHINE DRYER FABRIC

BACKGROUND OF THE INVENTION

1. Field of the Invention

The invention relates to dryer felts and more specifically relates to dryer fabrics for the manufacturing of fine grade paper.

2. Brief Description of the Prior Art

The art is replete with descriptions of dryer felts and dryer felt fabrics; see for example U.S. Pat. Nos. 2,098,993; 2,506,667; and 3,248,802. However, the heretofore available felts have not been completely satisfactory for all purposes. For example, in the manufacture of relatively fragile papers such as condenser, cigarette and Bible stocks, one must employ dryer felt having a very flat, soft face. Prior to our invention, such dryer felts were produced in an endless form from soft, spun yarns. They could be made from flat woven fabrics but the continuous soft face quality desired was interrupted by bulky seams, as known in the dryer felt industry, which would mark the sheet of paper being conveyed. This product is less advantageous because it is necessary to dismantle substantial proportions of the paper machine to install the endless felt and to replace felts. If it were possible to employ a seamed dryer fabric whose surface is not interrupted by a bulky seam area and is soft throughout its entirety it would be possible to install the felts without dismantling the paper machine.

The fabric of our invention is flat woven and has all of the surface characteristics desired for a dryer felt used in the manufacture of relatively fragile papers such as condenser, cigarette, Bible and like stocks. In addition, the fabric has the structural integrity required to join together the ends of the fabric in a conventional pin seam. Dryer felts prepared from the dryer fabric of our invention combine the properties of an all monofilament dryer felt including the ease of guiding, superior strength and pin seam capabilities, with that of an endless woven and/or needled dryer felt having a smooth, non-marking surface. In a preferred embodiment of the invention, a pin seam (as known in the dryer felt industry) may be incorporated into the monofilament base fabric and a spun yarn flap can then be created over the pin seam area. The flap gives the appearance of and acts like a completely smooth surface. Without the flap, an opening in the fabric would be present at the pin seam area. It is the fact that there is a smooth yarn surface, even at the pin seam area, that enables the seamed dryer felt of our invention to be used in place of an endless dryer felt of the prior art.

SUMMARY OF THE INVENTION

The invention comprises a dryer fabric, which comprises;

a multi-layer, flat woven, composite fabric having a duplex weave base of synthetic, polymeric resin monofilaments and a soft surface of woven yarns.

The fabric of the invention is useful to prepare dryer felts and the invention also comprises felts fabricated from the fabric of the invention.

In a preferred embodiment, the fabric of the invention is binder free. The term "binder free" as used herein means that the composite fabric of the invention is a unitary structure free of elements joined by binder yarns alone.

DETAILED DESCRIPTION OF THE PREFERRED EMBODIMENTS OF THE INVENTION

Those skilled in the art will readily appreciate the invention from the following discussion of the preferred embodiments when read in conjunction with the accompanying drawings of FIGS. 1 through 4, inclusive.

Figure 1:
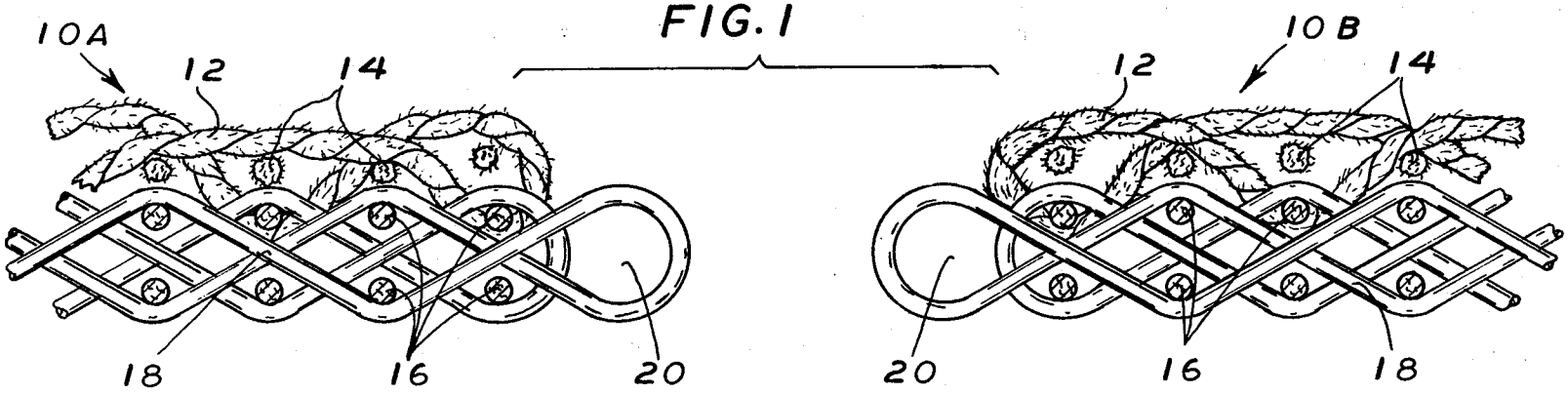
FIG. 1 is a cross-sectional side elevation of the two ends of a length of fabric embodiment of the invention.

Referring first to FIG. 1, a cross-sectional side elevation is seen of the end portions 10A and 10B of a length of embodiment fabric of the invention. The fabric is a multi-layer fabric free of binder yarns. The upper surface of the fabric consists of a single layer of interwoven spun yarns formed by the weaving of lengthwise or warp spun yarns 12 and crosswise or filler spun yarns 14. The spun yarns 12, 14 may be any spun yarns conventionally employed in dryer felts used for relatively fragile paper stocks. Alaternatively, the yarns 14 may be multifilament yarns. The yarns may have a size ranging from 100 grains to 3,000 grains per 100 yards. Generally, such spun yarns are represented by spun yarns of heat resistant, natural or synthetic staple fibers such as fibers of polyester, polyamide, polyacrylic, wool and like fibers and blends thereof. Those skilled in the art will appreciate that the degree of softness desired in the fabric surface may be controlled by selection of particular fibers in the spun yarns and by the amount of twist put into the spun yarns during their preparation.

The soft, spun yarn surface provides a heat barrier for the fabric of the invention and tends to protect the monofilament base which is otherwise susceptible to degradation.

Figure 2:
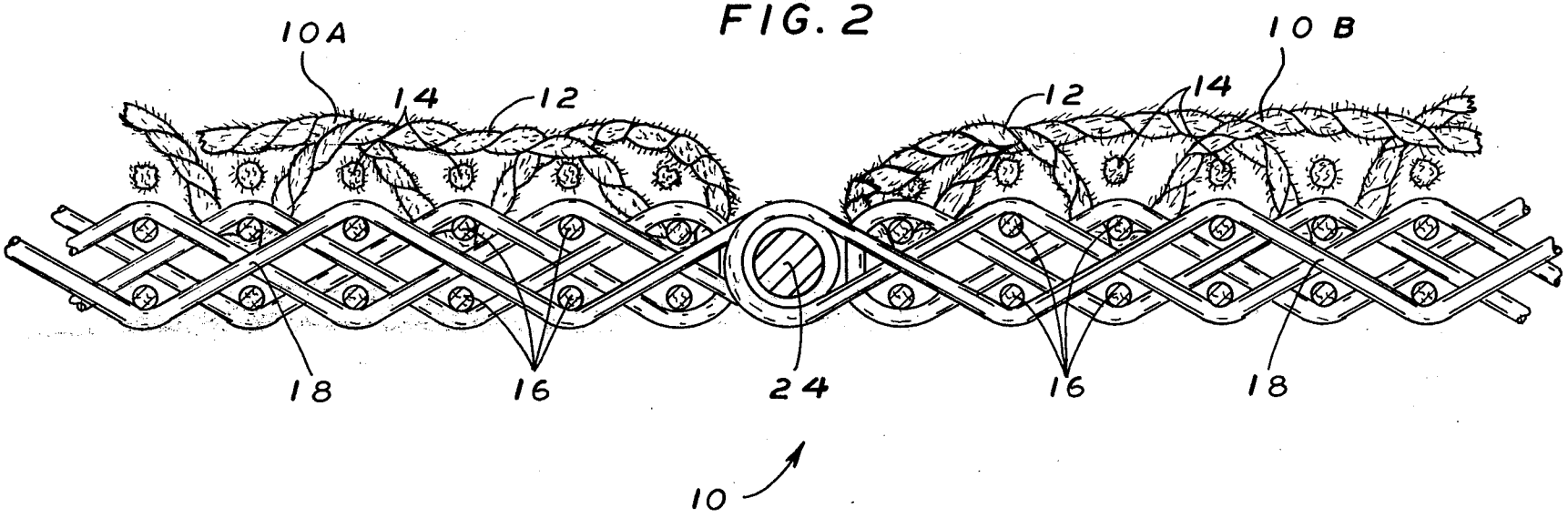
FIG. 2 is a view as in FIG. 1, but showing the joinder of the two ends by a pin seam.

As shown in FIG. 1, the base of the fabric ends 10A, 10B consists of a duplex type weave of lengthwise (warp) monofilament yarns 18 and crosswise (weft) monofilament yarns 16. The base of interwoven monofilament yarns provides a high degree of stability and structural integrity to the fabric of the invention. Any commercially available monofilament yarns having a diameter within the range of from about 0.008 to 0.040 inches may be employed as the yarns 16, 18. Representative of such yarns 16, 18 are monofilaments of polyamide, polyester, polypropylene, polyimide and the like. A number of lengthwise yarns 18 are provided having loops 20 at the fabric ends. The loops 20 are formed by conventional techniques well known to those skilled in the art and provide a means of forming a joinder and seam between ends 10A and 10B as shown in FIG. 2 wherein the ends 10A and 10B are joined by pin 24 passing through the loops 20 to provide an endless belt of fabric 10.

As stated above, the preferred fabric of the invention is a unitary, multi-layer structure free of binder yarns. The yarns 12, 14 are integrated with the base yarns 16, 18 by a lengthwise yarn 12 which occasionally dips to interweave with a crosswise monofilament yarn 16 in the fabric base as shown in FIGS. 1 and 2 providing what is known in the art as stitching points. The entire fabric structure 10 may be characterized as a smooth faced, multi-layer weave. The fabric 10 may be woven on a conventional papermakers felt loom in a single operation. The base yarns 16, 18 are woven while the spun yarns 12, 14 are woven directly above the base yarns 16, 18. The combining of the two yarn systems is performed during the weaving operation by sinking one of the spun yarns 12 to interlace with one of the monofilament base yarns 16 to provide the stitching points. The combining of the two systems is preferably in a set sequence, for example, on every other crosswise yarn 16 so as not to distort either the upper spun yarn surface or the monofilament yarn base.

The density of the warp yarns in the woven fabric of the invention would depend on the size of the yarn selected and may advantageously range from between 10 to 180 warp ends to the inch. Similarly, the number of crosswise or filling yarns may be between 10 to 60 yarns per inch. Within these density ranges, the upper surface acts as a heat barrier as the dryer fabric passes over steam heated cylinders or under hot air ducts to dry sheets of paper being conveyed thereon. The density ranges described above also assure that the sheet surface will be non-marking towards paper being conveyed thereon.

Figure 3:
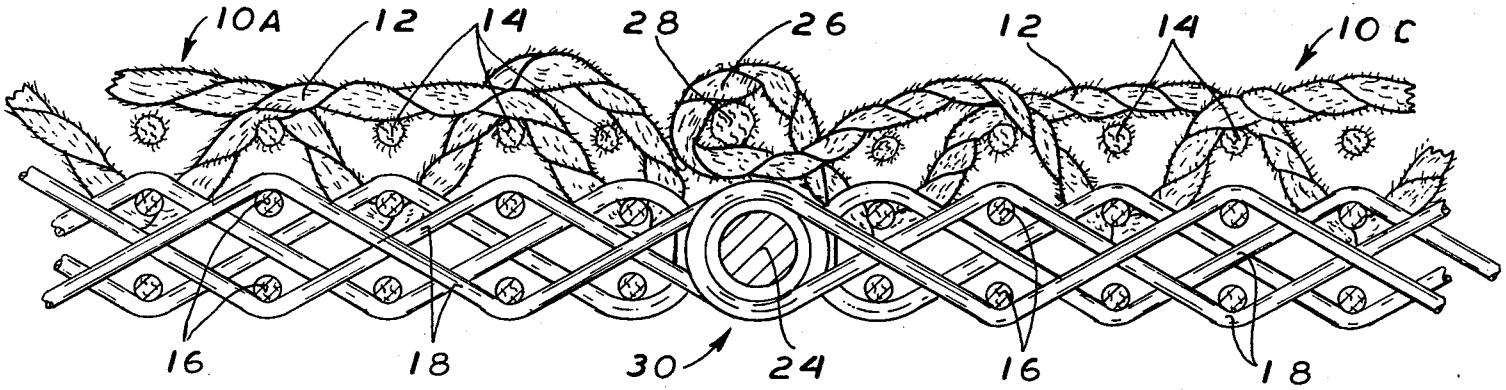
FIG. 3 is a cross-sectional side elevation of the joined ends of another embodiment of the invention.

Referring now to FIG. 3, there is seen a cross-sectional side elevation of the joined ends of a preferred embodiment dryer felt of the invention. In FIG. 3, those structures which are similar to those shown in the embodiments of FIGS. 1 and 2 are numbered alike. The embodiment of FIG. 3 however is covered in the seam area 30 by a spun yarn flap 26 which consists of a loop of lengthwise yarns 12 about a crosswise yarn 28. The flap 26 is loose and projects over the pin seam area 30 to assure a seam free surface for the dryer fabric.

Figure 4:
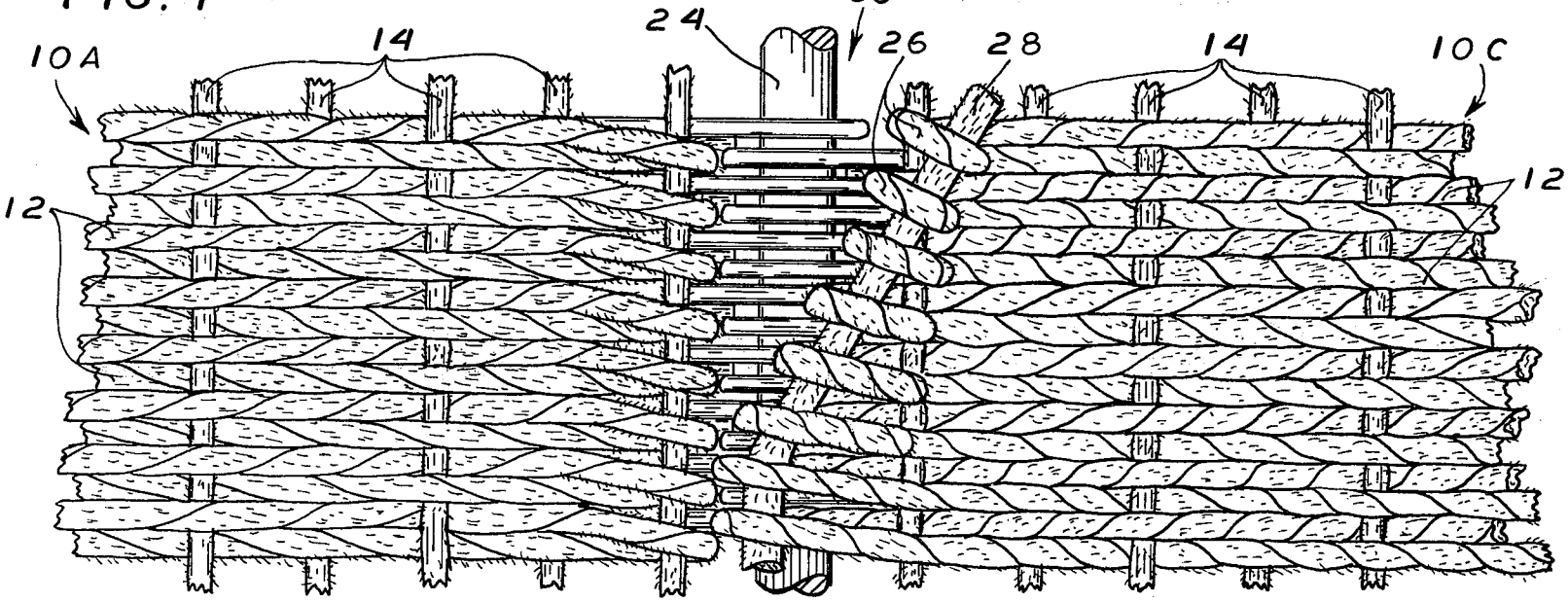
FIG. 4 is a fragmentary surface view of the embodiment of FIG. 3 showing the exposed seam between joined ends.

Referring to FIG. 4, a surface view of the embodiment of FIG. 3, one may see a portion of the flap 26 raised and the underlying pin seam. The preferred embodiments of FIGS. 3 and 4 assures a non-marking surface particularly in the pin seam area.

The following example describes the manner and process of making and using the invention and sets forth the best mode contemplated by the inventors of carrying out the invention but is not to be construed as limiting.

EXAMPLE 1

There is provided a quantity of 0.020 inch diameter polyester monofilament and a quantity of 0.021 inch diameter polyamide (nylon) monofilament yarn. There is also provided a quantity of 500 grain per 100 yard size spun acrylic/aramid (Nomex, DuPont Company) yarns having a ratio of 75% acrylic to 25% Nomex fibers. The monofilament yarns are woven together in a duplex pattern, i.e.; a double system of filling with a single system of warp yarns to form a base. The base is composed of two "ends" of the polyester monofilament and two "ends" of nylon monofilament alternating across the width of the fabric. Each "end" (warp) runs the length of the fabric. The spun yarn is simultaneously woven on top of the monofilaments so as to cover each pair of monofilaments, alternate spun yarns dropping down to interlace with alternate crosswise monofilaments.

The density of the monofilament warp yarns in the product is 48 ends to the inch in conjunction with 24 ends of spun yarn. The total end density is then 72 yarns to the inch. The number of "fillings" in the product is 25 monofilaments and 12½ spun yarns per inch for a total of 37½ fillings per inch.

The ends of the product are frayed to break the ends and monofilament loops hand-woven back to provide a seamed structure. The ends are joined with a pin through the loops to obtain an endless belt. When installed on a paper machine as a dryer felt, the fabric performs well in the manufacture of relatively fragile papers. The belt tracks well, is easily guided and exhibits a long life.

The felts of the invention may be finished in any conventional manner, i.e.; by heat setting and by chemical treatments to offer specific properties of runability and resistance to chemical and abrasive degradation.

Those skilled in the art will appreciate that many modifications to the above-described preferred embodiments may be made without departing from the spirit and the scope of the invention. For example, binder threads may be employed in addition to the stitching points.

What is claimed is:

1. A dryer felt, which comprises: a multi-layer, flat woven, composite fabric having a woven base of synthetic polymeric resin monofilaments and a soft surface of yarns which interweave with the monofilaments of the woven base to provide stitching points which secure the surface yarns to the base.

2. The fabric of claim 1 wherein said yarns are selected from the goup consisting of yarns spun from polyester, polyamide, polyacrylic, wool or other staple fibers and mixtures thereof.

3. The fabric of claim 1 wherein said yarns are a mixture of acrylic and aramid staple fibers.

4. The fabric of claim 1 wherein said yarns have a size ranging from 100 grains to 3,000 grains per 100 yards.

5. The fabric of claim 1 wherein said monofilaments are selected from the group consisting of polyester, polyamide, polypropylene and polyimide.

6. The fabric of claim 1 wherein said monofilaments have a diameter in the range of from 0.008 to 0.04 inches.

7. The fabric of claim 1 having a density of warp yarns in the range of from 10 to 180 warp ends to the inch and a density of filling yarns in the range of from 10 to 60 picks to the inch.

8. The fabric of claim 1 wherein said yarns are multifilaments.

9. The fabric of claim 1 wherein the ends are joined by a pin seam to form an endless belt.

10. The belt of claim 9 wherein said pin seam is covered by a flap of woven spun yarn continuous with said soft surface.

11. A dryer felt which comprises; a multi-layer, flat woven, binder free, composite fabric having a duplex weave base of interwoven polyester monofilament alternating with polyamide monofilament and a soft surface of interwoven spun yarns, said spun yarns consisting of a mixture of acrylic and aramid staple fibers covering said monofilaments;

the density of the fabric being 48 ends to the inch of monofilament warp yarns, 24 ends to the inch of spun warp yarns, 25 picks to the inch of monofilament filling yarn and 12½ picks to the inch of spun filling yarns.

12. A dryer felt, which comprises: a multi-layer, flat woven, composite fabric having a duplex weave base of synthetic polymeric resin monofilaments and a soft surface of yarns which interweave with the monofilaments of the woven base to provide stitching points which secure the surface yarns to the base.

* * * * *